US005735003A

United States Patent [19]

Judge

[11] Patent Number: 5,735,003

[45] Date of Patent: Apr. 7, 1998

[54] SLEEPING BAG ADAPTOR

[75] Inventor: Rob A. Judge, Salmon Arm, Canada

[73] Assignee: Robert Judge, Salmon Arm, Canada

[21] Appl. No.: 328,588

[22] Filed: Oct. 24, 1994

[30] Foreign Application Priority Data

Oct. 27, 1993 [CA] Canada ..... 2109387

[51] Int. Cl.[6] ..... A47C 29/00; A47G 9/06

[52] U.S. Cl. ..... 5/413; 5/420

[58] Field of Search ..... 5/413, 494, 498, 5/420; 2/69.5

[56] References Cited

U.S. PATENT DOCUMENTS

| | | | |
|---|---|---|---|
| 2,826,766 | 3/1958 | Stoner | 5/498 |
| 3,083,378 | 4/1963 | Pursell | 5/413 |
| 3,178,734 | 4/1965 | Carrez | 5/413 |
| 3,268,922 | 8/1966 | Moxley | 5/420 |
| 3,798,686 | 3/1974 | Gaiser | 5/413 |
| 3,831,206 | 8/1974 | Geary | 5/413 |
| 3,877,092 | 4/1975 | Gaiser | 5/413 |
| 4,183,111 | 1/1980 | Zahavkochav | 5/413 |
| 4,301,561 | 11/1981 | McLeod | 5/498 |
| 4,413,368 | 11/1983 | Schuetze | 5/494 |
| 4,513,461 | 4/1985 | Tardivel | 5/413 |
| 4,605,029 | 8/1986 | Russell | 5/413 |
| 5,005,235 | 4/1991 | Huang | 5/413 |
| 5,092,010 | 3/1992 | Wong | 5/498 |
| 5,099,531 | 3/1992 | Schmier | 5/498 |
| 5,144,911 | 9/1992 | Moore et al. | 5/420 |
| 5,193,235 | 3/1993 | Kircher | 5/494 |

FOREIGN PATENT DOCUMENTS

| | | | |
|---|---|---|---|
| 286291 | 10/1988 | European Pat. Off. | 5/413 |
| 3328076 | 2/1985 | Germany | 5/413 |

*Primary Examiner*—Michael J. Milano

[57] ABSTRACT

The present invention concerns an adaptor which removably fastens together with ordinary sleeping bags to make them larger and less susceptible to use-related wear. In the preferred embodiment, the adaptor resembles a sleeve which may encase a sleeping pad (or lightweight camping mattress) incorporating one half of a normal sleeping bag zipper along each side.

33 Claims, 16 Drawing Sheets

SLEEPING BAG ADAPTOR

The present invention relates to an adaptor for fastening a sleeping bag to a camping pad.

Usually, in quality lightweight camping gear, sleeper and a closed cell foam pad or a pad of open cell foam in an airtight sheath rests under the sleeper and bag. Because sleeping bag fill is highly compressible, that portion of the sleeping bag which lies directly under the sleeper is compressed and has very little insulative value. So the sleeping pad is designed to provide thermal insulation as well as comfort under the sleeper's weight. This system has the following drawbacks: (1) That portion of the sleeping bag which remains compressed under the weight of the sleeper is essentially "dead weight" ie, it adds weight and bulk to the system without providing much utility. (2) Compressing any part of the fill reduces its longevity, also, sweat drips down into the fill further deteriorating it. (3) Lightweight sleeping bags are small and restrict occupant movement. This is particularly a problem to mild claustrophobics and adventurers who can become trapped in tents for extended periods by blizzards, etc. (4) Because light camping mattresses are only about 50 cm wide, and also due to the slipperiness of the synthetic materials involved, the sleeping bag sometimes slides off the mattress leaving the sleeper directly on snow or rock, etc. (5) If more than one mattress is used (ie stacked vertically for extra thickness or laid out for extra length) they can drift askew. (6) To avoid some of the above problems, campers will sometimes open a sleeping bag up along the zipper line and open it up to use as a quilt. The drawback with this method is that draughts are difficult to seal out.

The invention may consist of a sleeve into which a normal camping pad may be inserted. A normal sleeping bag can then be temporarily attached to a zipper or other elongated fastener provided on the sleeve for this purpose. Alternately, the invention may be a pad with an elongated fastener incorporated.

To prevent drafts intruding through the longitudinal fastener, either an underlap or a baffle system may be used. With the underlap, the longitudinal fastener is routed so that an attached sleeping bag would underlap the edge of the pad/adaptor. With the baffle, a semi-rigid material is enclosed in the baffle which is attached to the adaptor in such a way as to lie against the longitudinal fastener and therefore touching the edge of any attached sleeping bag.

The invention, when attached to a sleeping bag and a pad (if applicable) provides an envelope with the pad on the bottom and the sleeping bag across the top. The sleeping bag is attached along each side and across the foot end to the adaptor.

The invention may be produced in either single or double versions to accommodate a single person or a couple. The single version engages a sleeping bag to either side of a single pad. The double engages a sleeping bag so as to span two pads with the single sleeping bag. A convertible version of the invention is used by either a single person or a couple. This version has three longitudinal fastening elements. If a conventional zipper is being used, this version uses three halves of a zipper, two along the edges as with a normal adaptor, and a third half would run along the centre of the bottom of the adaptor. For use by a couple, the central fastening element is ignored. For use by a single person, half of the adaptor is bunched up inside the sleeping bag and the central fastening element is attached to one side of the sleeping bag. In this mode a pad is only inserted into one side of the adaptor or with an integral pad version, one side is left deflated.

All versions may be fitted with a system for drawing the sleeping bag snugly about the user's neck (or users' necks). The preferred system has the centre of a drawstring attached to the adaptor below the user's neck(s). At each end of the drawstring is a small device such as a hook, which engages with the zipper's slider (or corresponding part on another type of fastener), and a smell toggle or cord clamp. This toggle allows the fastener and hence the sleeping bag to be drawn tightly about the user's neck(s) and held there. It also prevents inadvertent unfastening during the night. In the event of an emergency this type of clamp would submit to a strong push by the user.

In order for this drawing system to work, an area of the top sheet must be free at each side to be pulled in toward the centre, on sleeve type versions this is allowed for by extending the top sheet toward the head end further than the bottom sheet or set of straps. On integral pad versions, a portion of top sheet to which the head end of the fastener attaches may be provided.

On double wide versions, an area between the necks is potentially left open to drafts. To obviate this problem an insulating yoke may be provided which could removably attach to the adaptor or simply secure about the necks of the users. This yoke both shoulders of the users and could incorporate a pair of hoods for extra warmth.

Since the top sheet extends beneath the head of a user, providing a pocket in this region of the top sheet would create a convenient pillow-case.

In some cases, particularly single versions, the edges of the sleeping bag may roll out sideways and contact wet snow or dirt, etc. To prevent this, moisture resistant skirts may be provided which will attach to the adaptor and lie along each side of it.

The invention may be constructed differently to accommodate different types of sleeping bags. For "barrel" style sleeping bags, the foot section may be an insulated pad carrying the lower end of the zipper or fastener which is contiguous with that sewn to the sleeve. For "Mummy" style sleeping bags, the foot section may be tapered to accommodate the fastener opening found along the side of most mummy bags. For any particular style, size and shape of sleeping bag available in the marketplace, a version of the invention most suited to that particular sleeping bag may be produced incorporating a fastener routing best suited to adapt that sleeping bag to any particular sleeping pad. This routing may or may not involve the use of a padded foot section to optimally provide a comfortable assembly using any particular sleeping bag style or size.

FIG. 1 illustrates the "single mummy" version of this invention in perspective, adjacent to a commercial camping pad.

FIG. 2 shows the pad inserted into the invention.

FIG. 3 illustrates a commonly available "mummy" style sleeping bag attached using its zipper and that provided on the invention to the assembly shown in FIG. 2.

Figure 4:
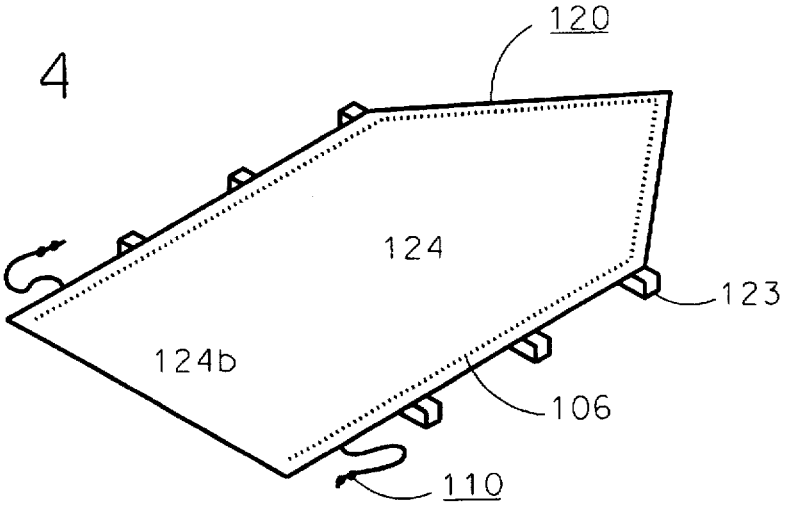
FIG. 4 illustrates an adaptor similar to that portrayed in FIGS. 1–3, except that this is the double version, and has straps instead of a solid bottom.
Figure 5:
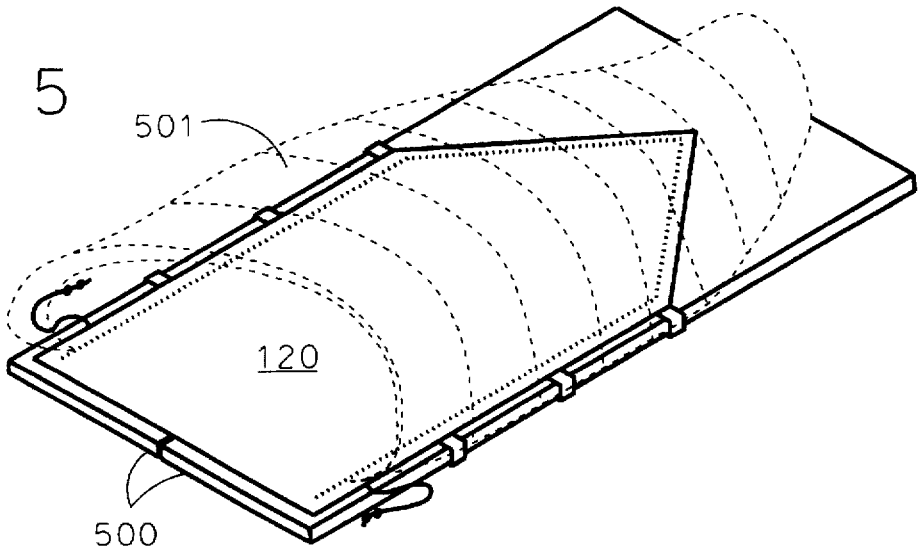

FIG. 5 portrays the version of FIG. 4 as it would appear in use: with two camping pads inserted and one mummy sleeping bag attached.

Figure 1:
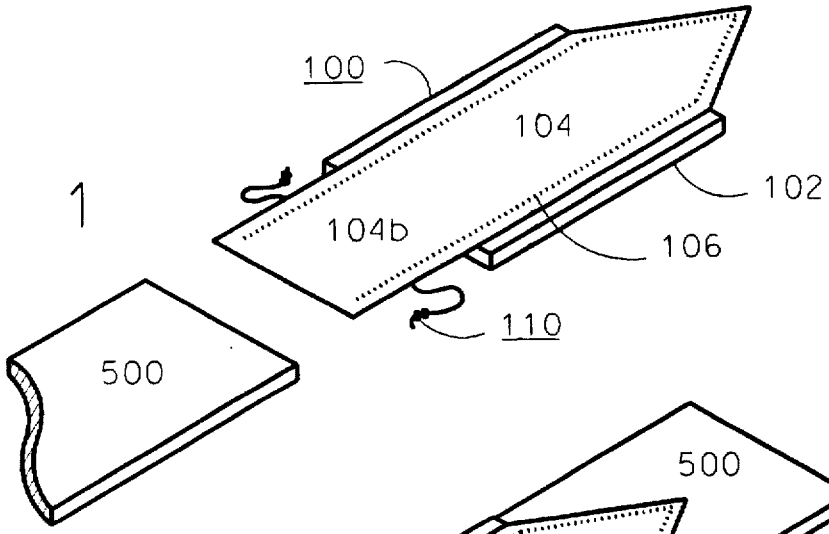
FIGS. 1, 2 and 3 are a sequence of perspective views of the sleeping bag adaptor of this invention being prepared for use.
Figure 2:
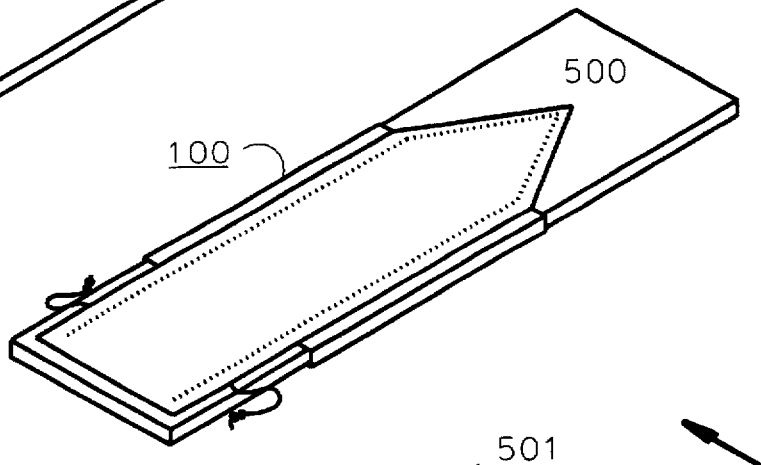
Figure 3:
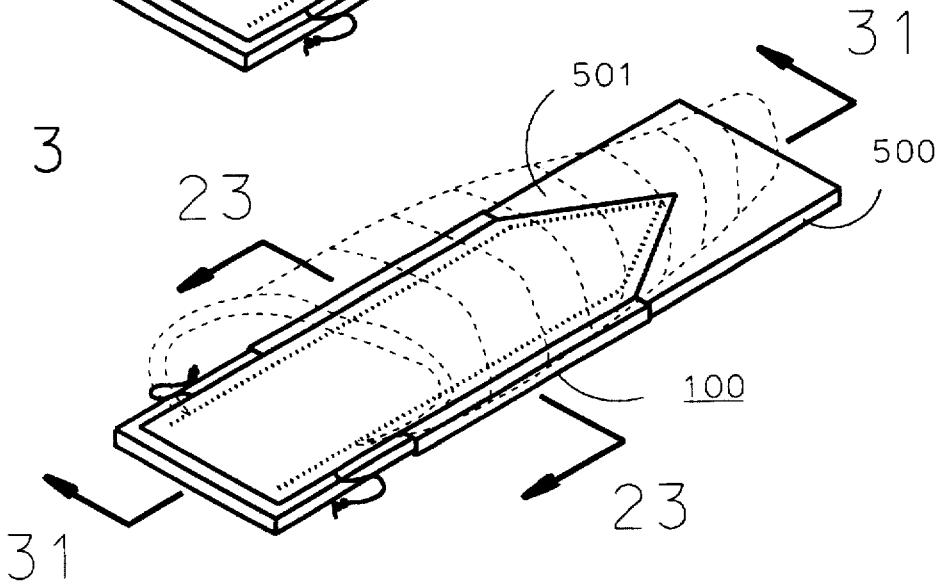
Figure 6:
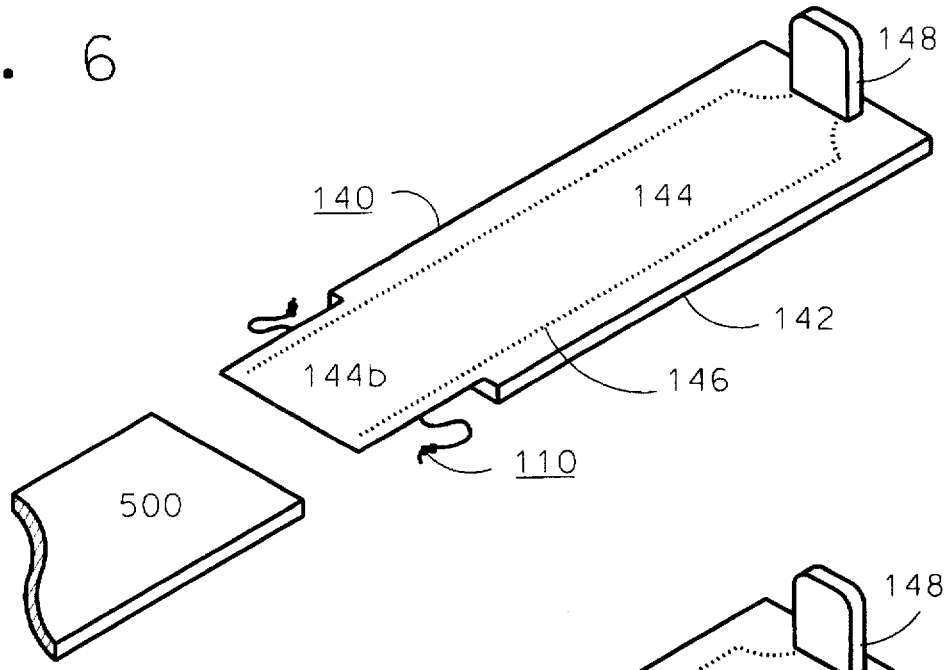
Figure 7:
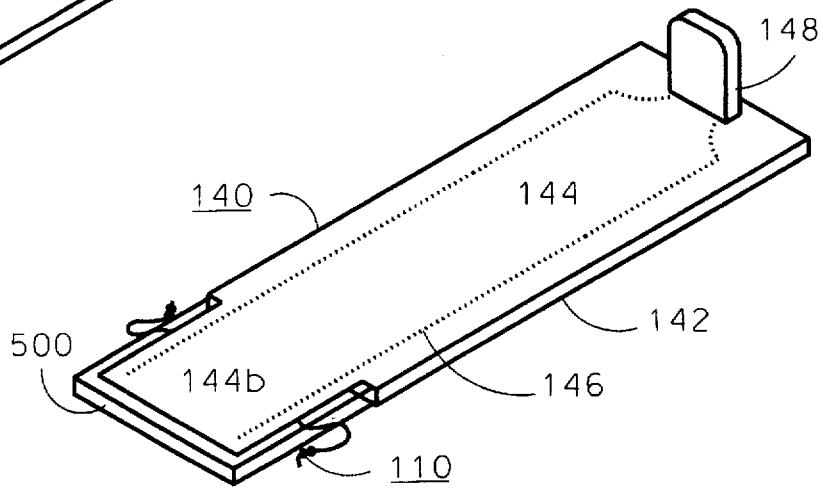
Figure 8:
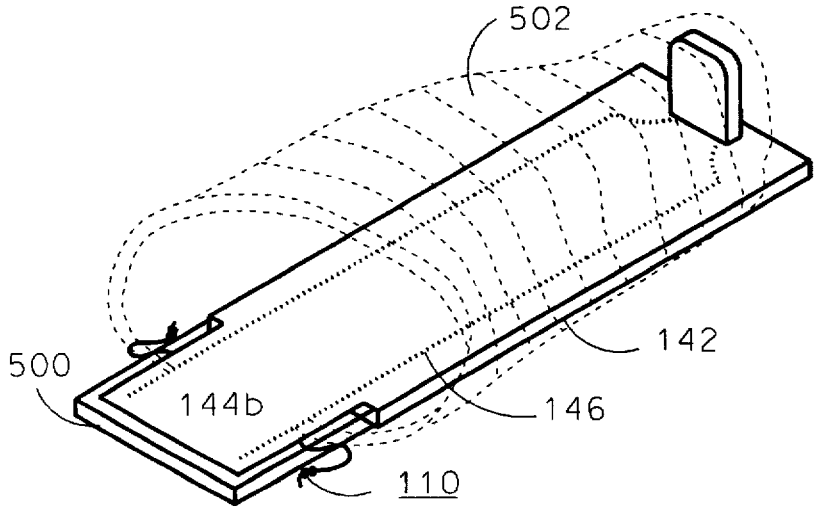

FIGS. 6–8 illustrate a sequence similar to that in FIGS. 1–3 except that this version is designed to mate with a "barrel" or "rectangular" style sleeping bag.

Figure 9:
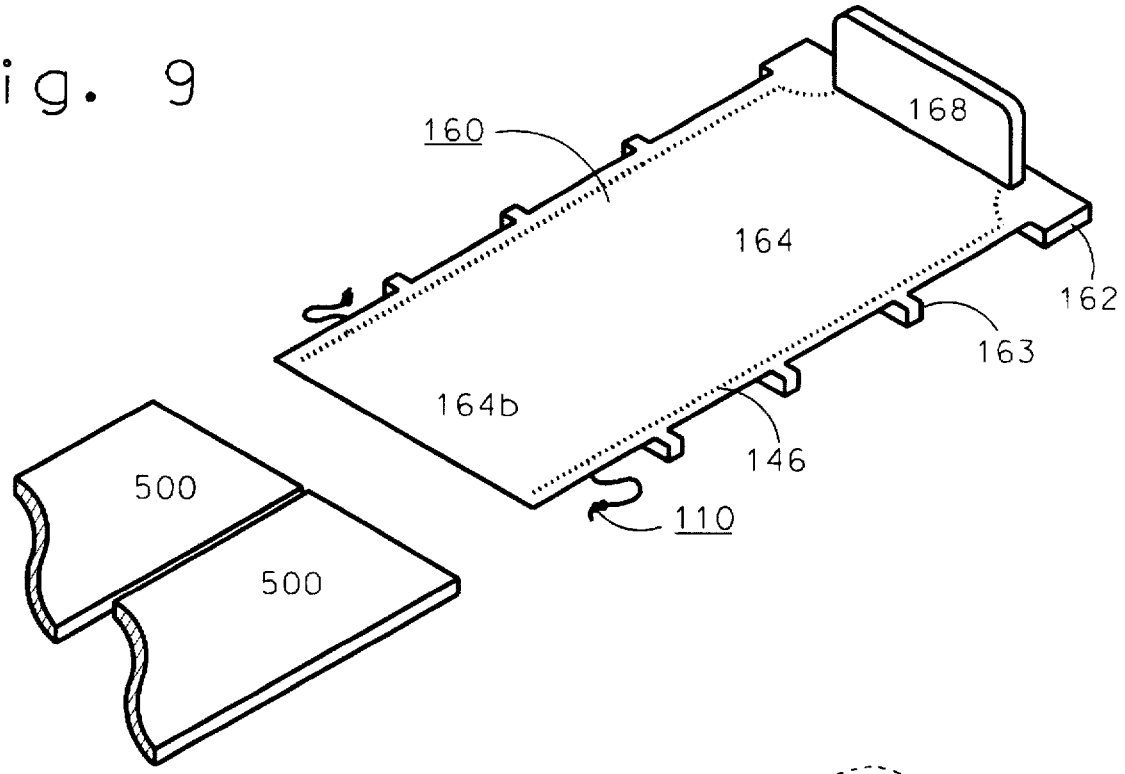
Figure 10:
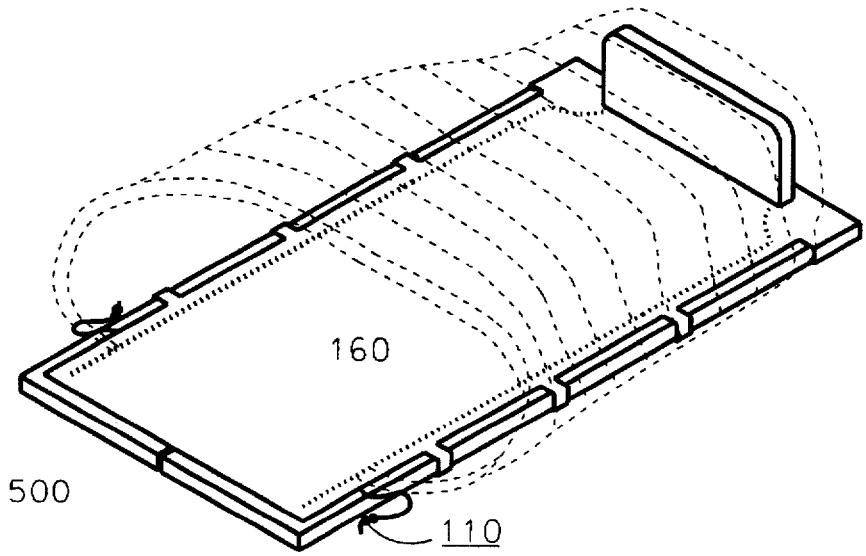

FIGS. 9 and 10 portray a double sleeping bag adaptor designed for the barrel or rectangular style sleeping bag.

Figure 11:
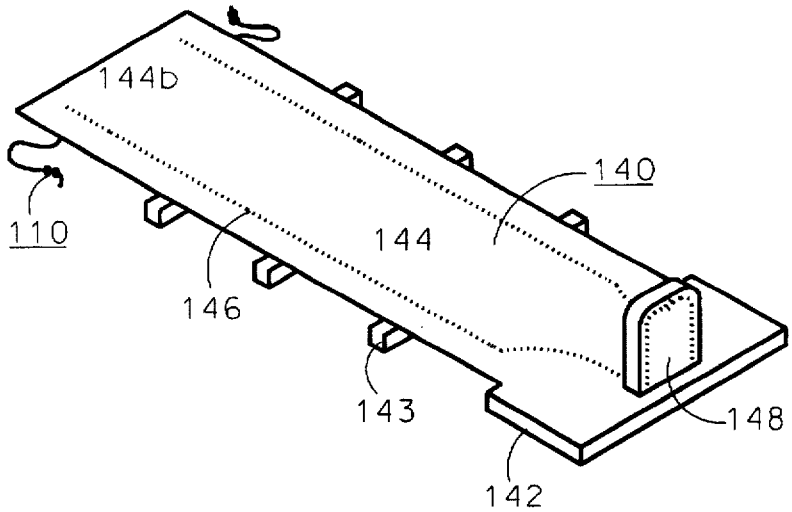

FIG. 11 is a perspective from the foot end of the same version of the invention as is portrayed in FIGS. 6–8 except that the underside is fashioned of straps instead of a solid sheet.

Figure 12:
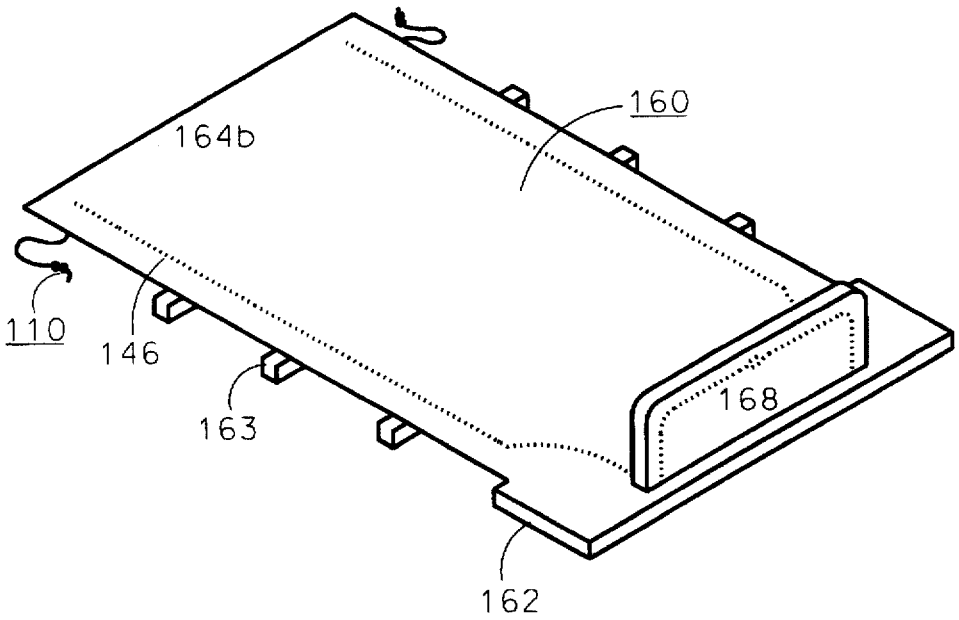

FIG. 12 is a perspective from the foot end of the same version portrayed in FIGS. 9 and 10.

Figure 13:
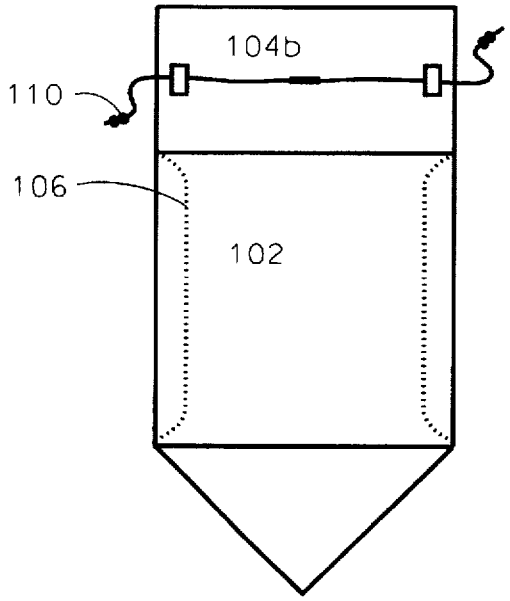

FIG. 13 is an underside elevation of the single mummy version similar to that in FIGS. 1–3.

Figure 14:
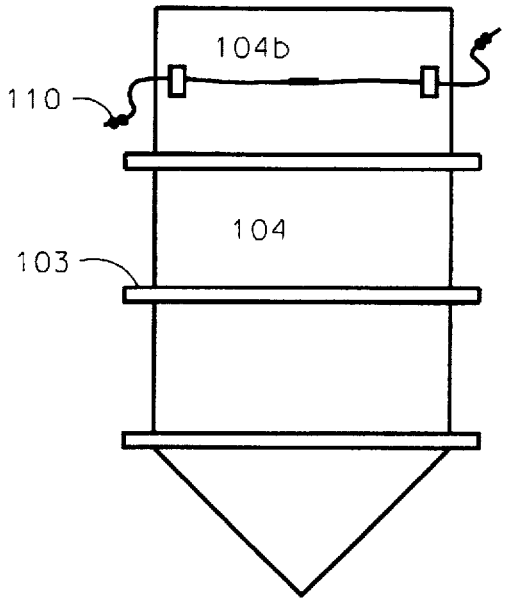

FIG. 14 is an underside elevation of the single mummy version with straps instead of a solid bottom.

Figure 15:
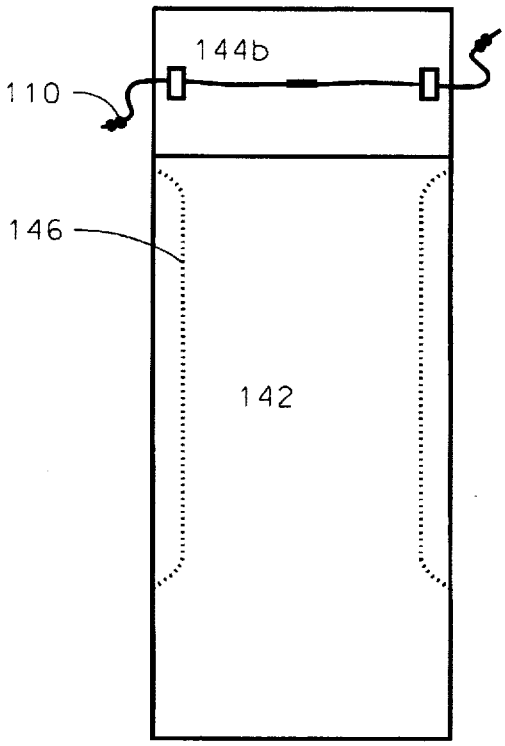

FIG. 15 is an underside elevation of the single barrel version similar to that shown in FIGS. 6–8.

Figure 16:
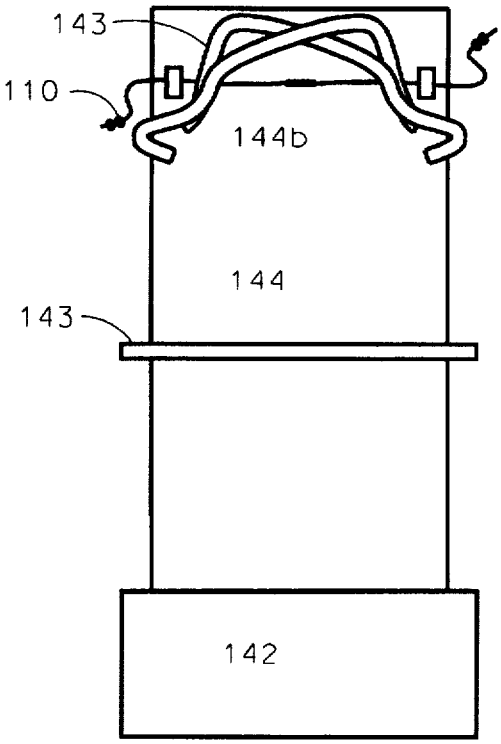

FIG. 16 is an underside elevation of the single barrel version with straps instead of a solid bottom.

Figure 17:
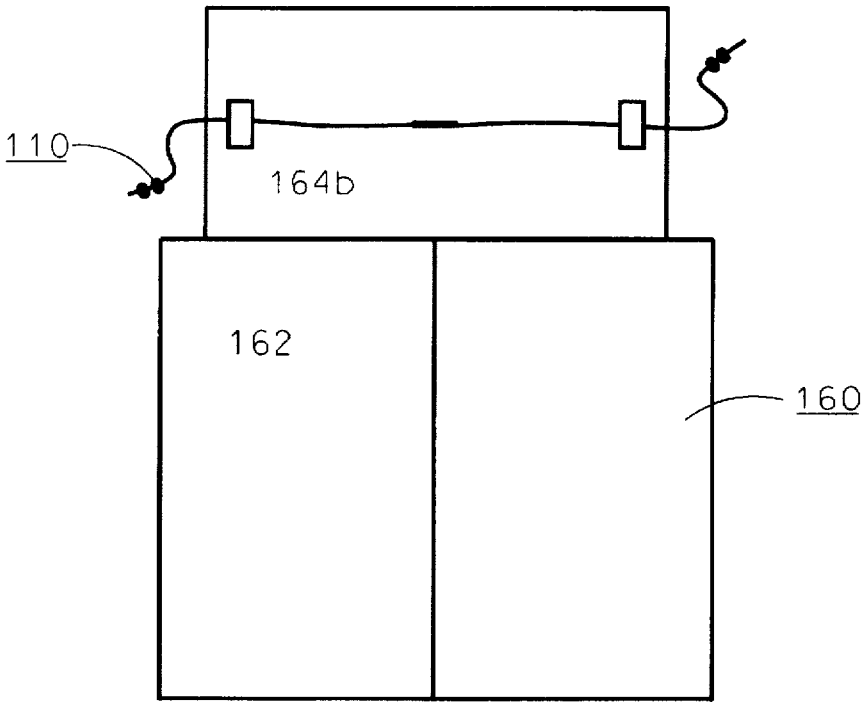

FIG. 17 is an underside elevation of the double barrel version with a solid bottom.

Figure 18:
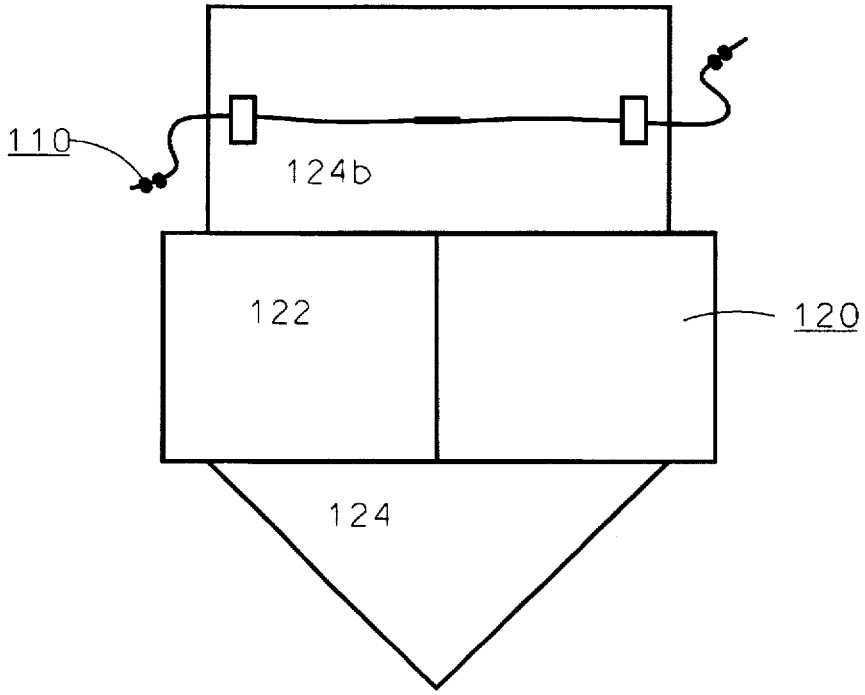

FIG. 18 is an underside elevation of the double mummy version with a solid bottom.

Figure 19:
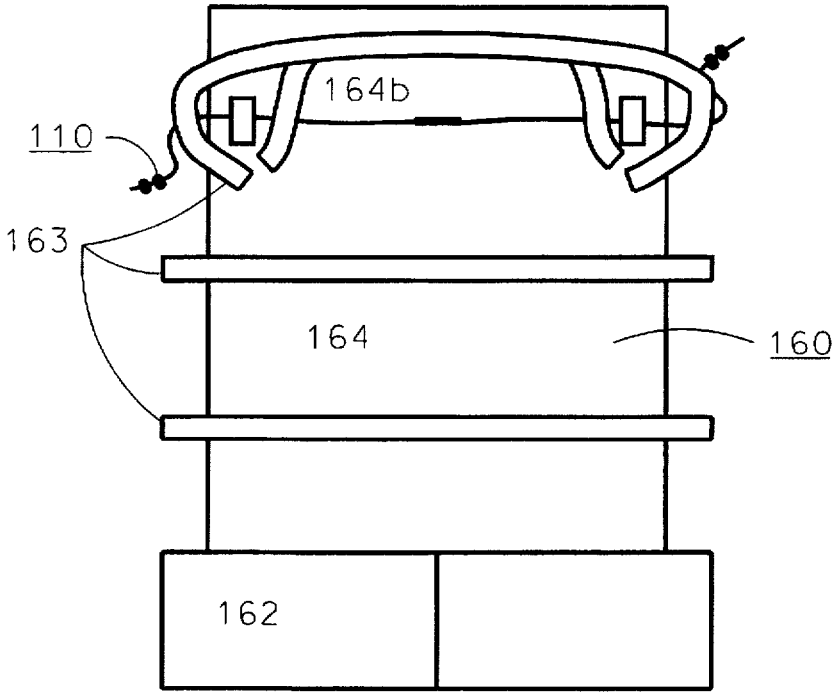

FIG. 19 is an underside elevation of the double barrel version with straps instead of a solid bottom.

Figure 20:
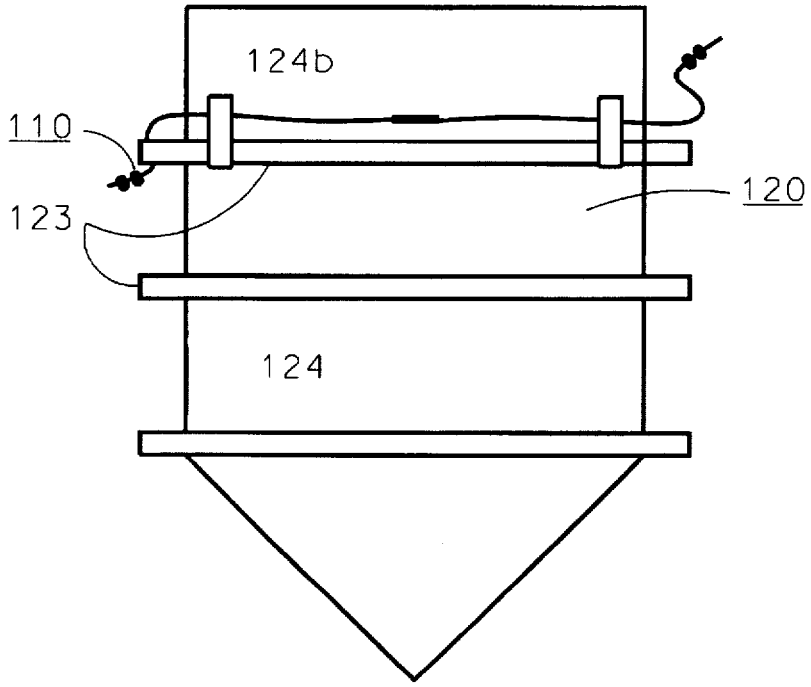

FIG. 20 is an underside elevation of the double mummy version with straps instead of a solid bottom.

Figure 21:
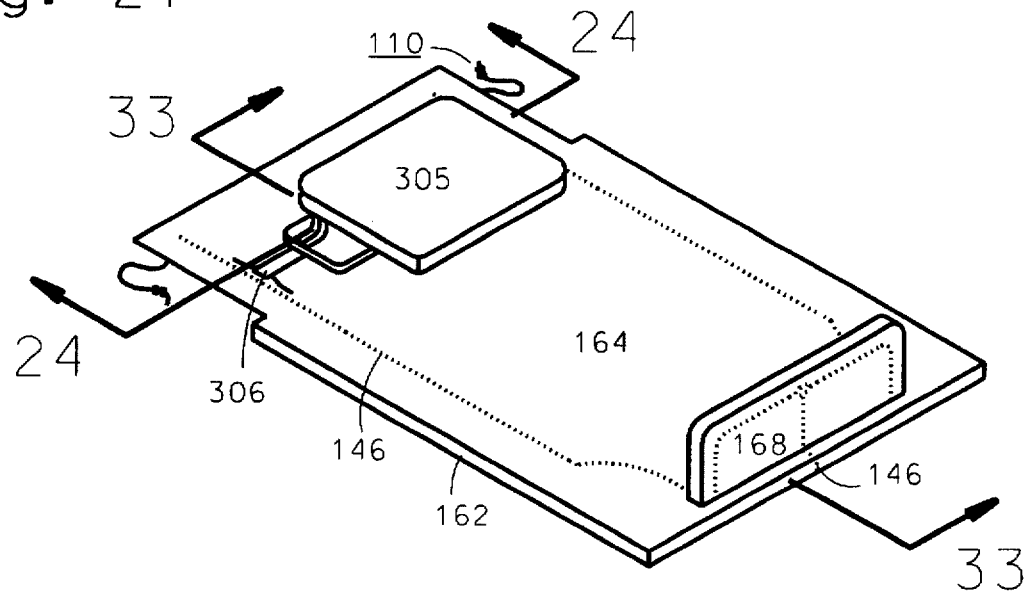

FIG. 21 illustrates a double barrel solid bottom version of the present invention with the addition of a third longitudinal fastening element to provide a convertible embodiment of the invention. FIG. 21 also illustrates an insulating neck yoke removably attached.

Figure 22:
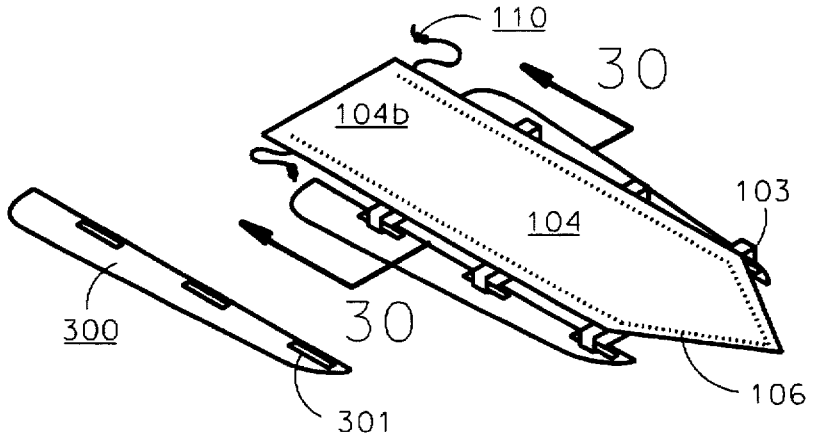

FIG. 22 illustrates removable moisture impermeable skirts attached in this case to a single mummy version.

Figure 23:
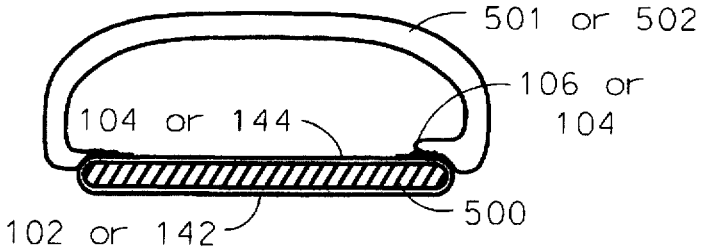

FIG. 23 is a cross section of the preferred embodiment of either single version.

Figure 24:
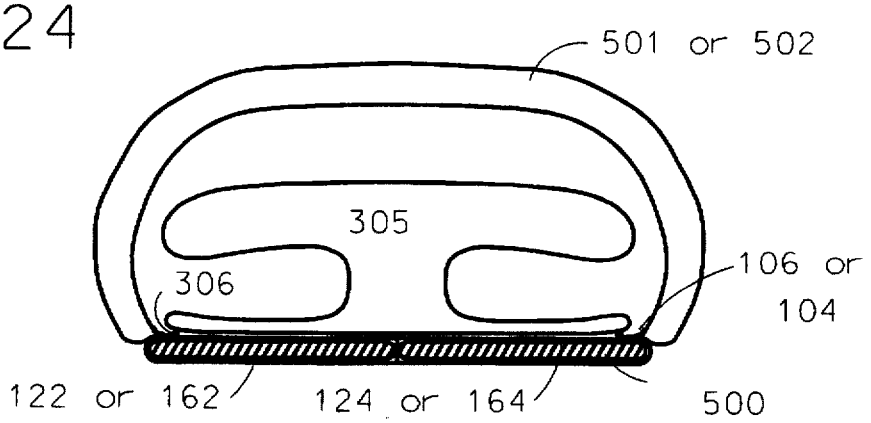

FIG. 24 is a cross section of the preferred embodiment of either double version with a removably attachable insulating yoke shown in section.

Figure 25:
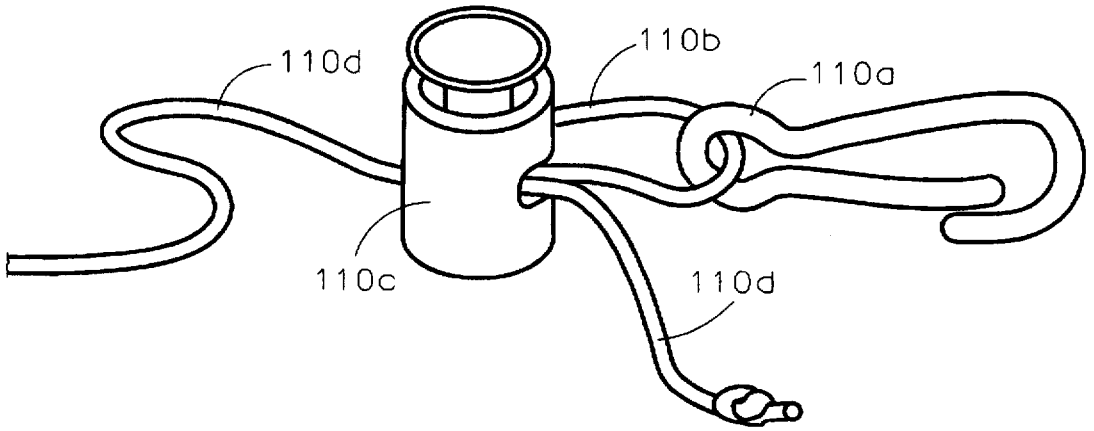

FIG. 25 illustrates in large scale, a hook assembly used as a means for drawing the sleeping bag about a user's neck.

Figure 26:
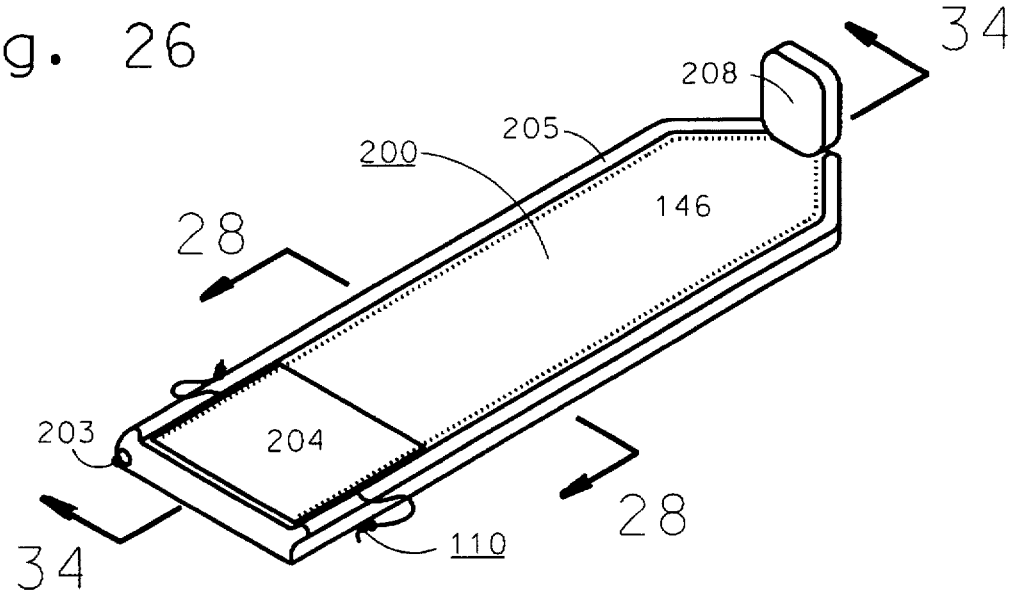

FIG. 26 portrays in perspective an adaptor according to the invention in which the cushioning pad and side draft baffles are integral parts of the adaptor which in this case is a single barrel version.

Figure 27:
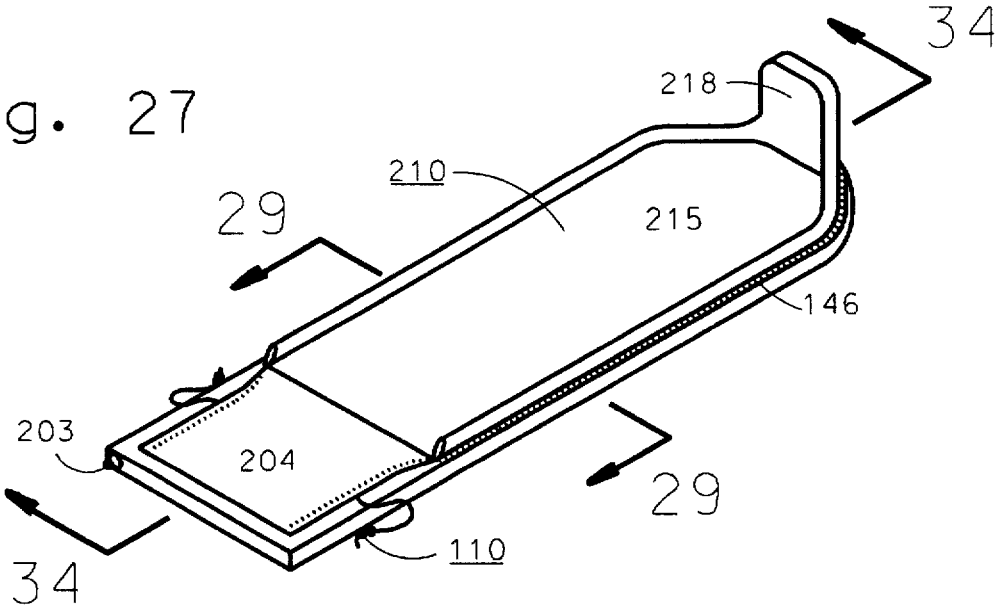

FIG. 27 illustrates an adaptor in perspective very similar to that in FIG. 26 except that the side draft baffles are located just inboard of the longitudinal fastening elements.

Figure 28:
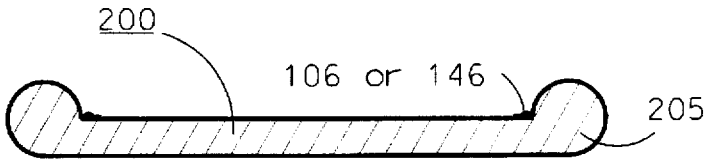

FIG. 28 is a cross section of the adaptor shown in FIG. 26.

Figure 29:
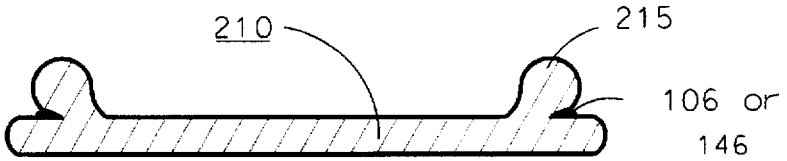

FIG. 29 is a cross section of the adaptor shown in FIG. 27.

Figure 30:
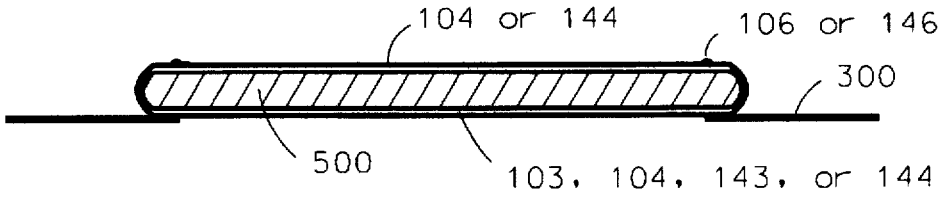

FIG. 30 is a cross section of the assembly shown in FIG. 22.

Figure 31:
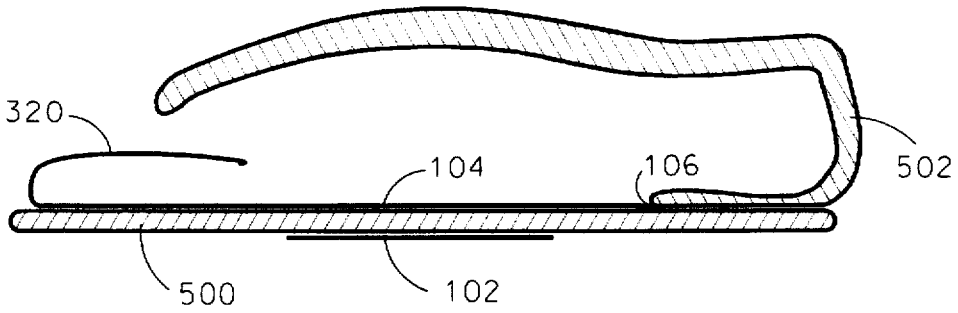

FIG. 31 is a longitudinal section of the adaptor/pad/sleeping bag combination of FIG. 3 or 5 with the addition of a pillow case.

Figure 32:
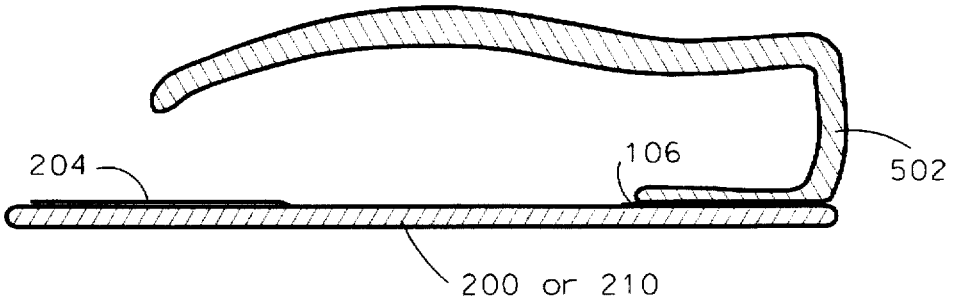

FIG. 32 is a longitudinal section very similar to FIG. 31 except that the pad is integral with the adaptor and no pillow case is provided.

Figure 33:
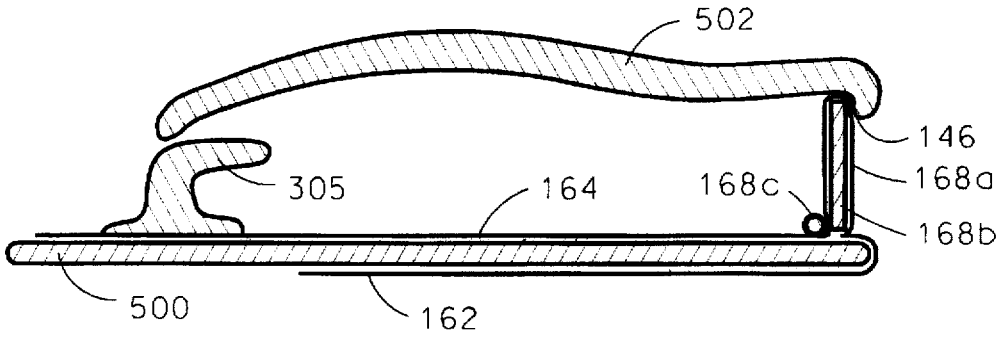

FIG. 33 is a longitudinal section of the adaptor/neck yoke/pad/sleeping bag combination seen in FIG. 21.

Figure 34:
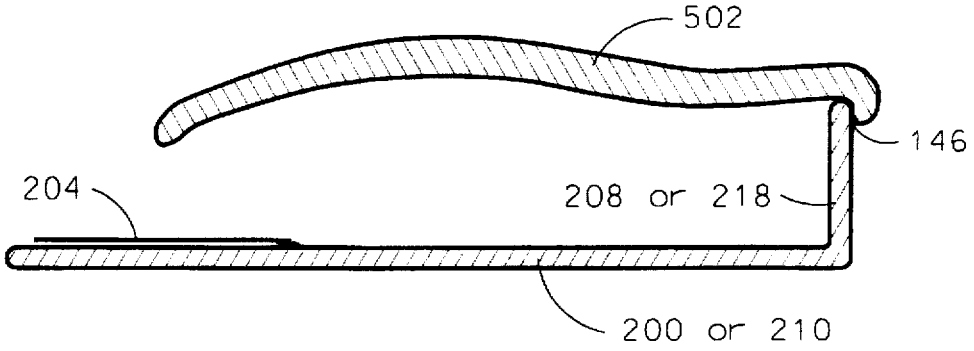

FIG. 34 is a longitudinal section of a sleeping bag combined with an integral pad barrel version of the invention as seen in FIGS. 26 and 27.

Figure 35:
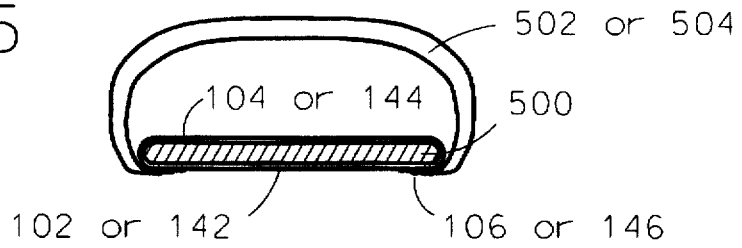

FIG. 35 is a cross section of the underlapping sleeping bag embodiment of the invention as in FIGS. 13 or 15 with a sleeping bag attached.

Figure 36:
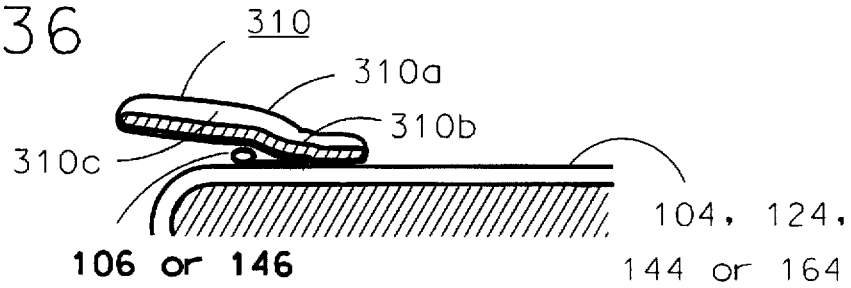

FIG. 36 illustrates a cross section of a side draft baffle according to the present invention, drawn to a large scale.

Figure 37:
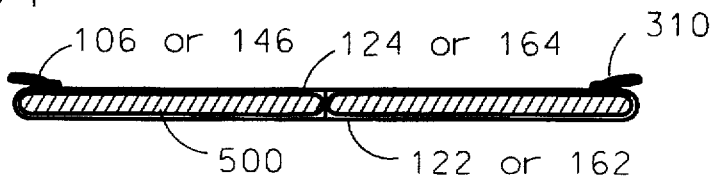

FIG. 37 shows the same baffle as 36 drawn to a smaller scale and showing its attachment to a double-wide adaptor and two pads.

Figure 38:
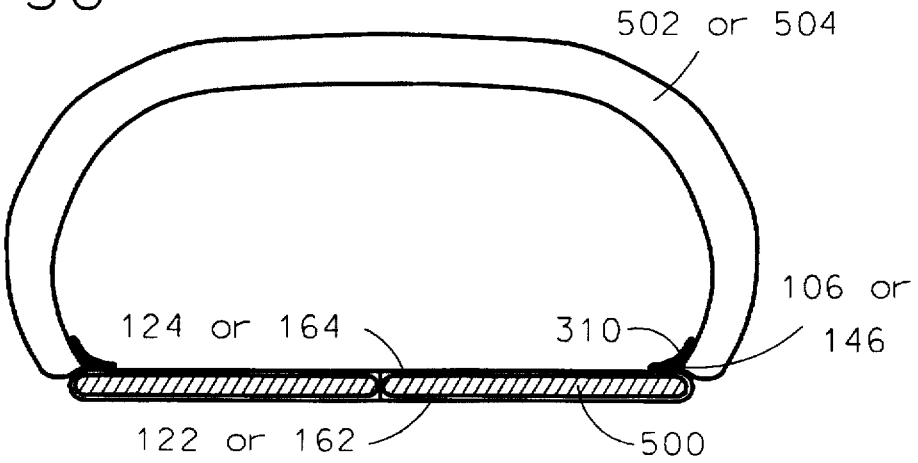

FIG. 38 is a sleeping bag in cross sect/on attached to the assembly of FIG. 37.

Figure 39:
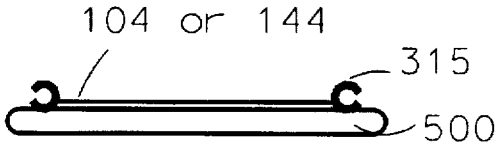

FIG. 39 portrays in cross section, a resilient tube style elongated fastener used as an alternative to a zipper. No adaptor bottom is apparent as the section is taken between straps on a strap-bottom version.

Figure 40:
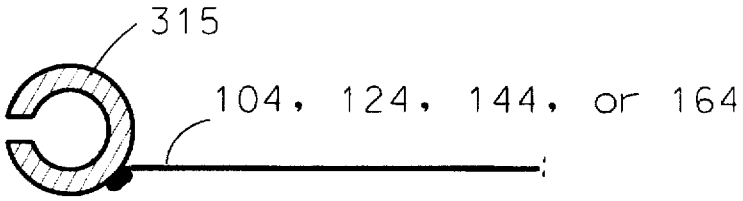

FIG. 40 is a detail in section of FIG. 39.

Figure 41:
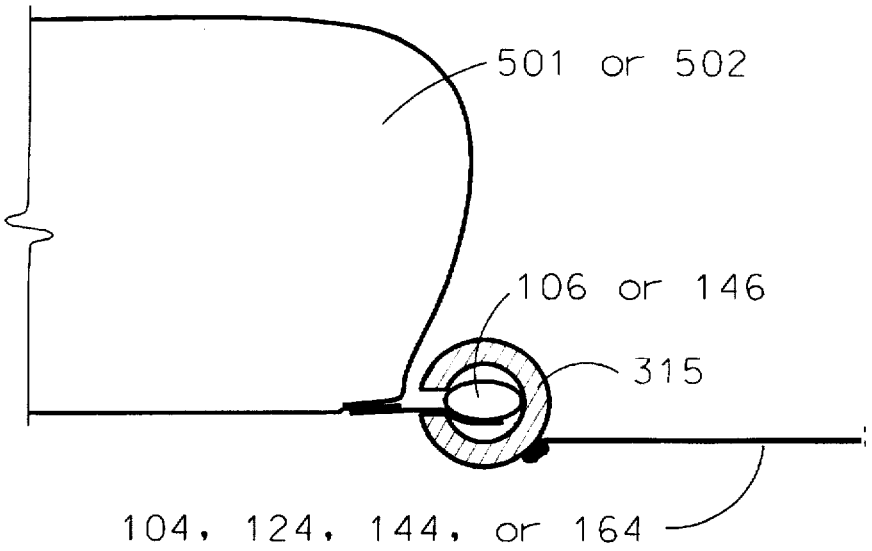

FIG. 41 illustrates the same detail as FIG. 40 removably attached to the zipper element of a sleeping bag also shown in section.

The present invention essentially comprises four chief versions of the preferred embodiment. The first, 100 (FIG. 1), adapts a "mummy" style sleeping bag 501 to a camping pad 500 in a manner which provides increased interior volume hence increased spaciousness for a single camper. The second, 120 (FIG. 4), adapts a mummy bag 501, to two pads laid side by side thereby providing sufficient interior space for two campers. The third, 140 (FIG. 6), adapts a "barrel" or "rectangular" style sleeping bag 502, to a single pad for increased space for a single camper and the fourth embodiment, 160 (FIG. 9), adapts a "barrel" or "rectangular" bag 502, to two pads to accommodate two campers.

In use, a commercially available camping pad 500, is slid into the sleeve formed by the adaptor, and a conventional sleeping bag is zipped or attached to the resulting combination. FIGS. 1–3 illustrate this sequence for the single mummy version. The sequence is repeated slightly conflated in FIGS. 4–5 for the double mummy version, repeated again for the single barrel version in FIGS. 6–8, and repeated again conflated for the double barrel version in FIGS. 9–10.

In reference to all these versions, FIGS. 1–12, an adaptor 100, 120, 140 or 160 comprises: a sleeve preferably made of fabric, essentially comprising a lower element such as a sheet, 102, 122, 142 or 162 or a series of straps, 103, 123, 143, or 163, and an upper element or sheet, 104, 124, 144, or 164. Common to the four embodiments is an elongated fastening element, usually a zipper, 106 for the mummies and 146 for the barrels, to which a conventional sleeping bag is attached using its own zipper. Means 110, are provided for drawing the elongated fastening elements together thus gathering the sleeping bag about the neck of a user. This drawing means appears in greater detail in FIG. 22. A portion of the top sheet at the head end **104*b*, 124*b*, 144*b*, or 164*b* may be left free of attachment along its sides to act in sympathy with the drawing means. If a portion of the top sheet adjacent to the user's head comprises a fabric pocket, this may act as a pillow case 320 as seen in FIG. 31**.

The barrel or rectangular style of sleeping bag 502, is usually able to zip entirely open on two sides. Since it is already open across the top, it can unzip and lay flat just like a quilt or eiderdown. This style of sleeping bag is best shaped to accommodate users' feet when the foot end of the sleeping bag is attached to the periphery of a squarish foot pad, 148 or 168, FIGS. 6–12. FIG. 33 shows a section of the preferred embodiment of such a pad. In the footpad, a fabric shell **148*a* or 168*a* can encase a closed cell foam element 148*b* or 168*b* and a baffle 148*c* or 168*c*** may be included for draft elimination along the bottom. A normal type of baffle, ie a long fabric pouch stuffed with down or similar insulating fill material is too limp to be effective along the top and sides of the footpad where it meets the sleeping bag. This is why a semi rigid substance like closed cell foam is valuable. It holds the edges of the foot pad rigid out beyond the fastener so that the sleeping bag wraps around the edge of the foot pad to seal out draughts as seen at the top of the foot pad in FIG. 33. FIG. 34 illustrates how a very similar system works on integral pad versions. FIGS. 11 and 12 show how the footpad extends beyond the elongated fastener at the sides as well as the top of the foot pad and how, due to this overlap, the fastener disappears under the edge of the footpad at its bottom corners. This is also the point where the fastener leaves the footpad and joins the top sheet of the adaptor. Naturally, the foot pad is only fastened to the adaptor between the fastening elements so that the sleeping bag may hook under the bottom outside edges of the foot pad. Extra thermal insulation may also be included in the foot pad. Again, referring to FIGS. 6–12. The elongated fastening elements 146, may incorporate a curve or curves adjacent to the foot pad to give the sleeping bag 502 an appropriate lie with no tight spots or drafts. The origins of the elongated fastening elements 146, start near the top centre of the foot pad on its tail end surface as seen in FIGS. 11 and 12.

FIGS. 13 to 20 show the undersides of the four preferred embodiments with solid lower elements and alternately with straps. The drawing means, 110, detailed in FIG. 25, are attached only near the centre of the adaptor so that the hook assemblies comprising a hook 110*a*, loop 110*b* and a toggle 110*c*, can slide up the main cord 110*d*, almost to the centre of the adaptor. FIG. 25 illustrates a hook assembly in detail. In the preferred mode of use, the hook 110*a*, engages the sliding tab of the zipper or fastener, performing the dual function of preventing the fastener's slider from retreating down the fastener, and in cooler weather drawing the sleeping bag/adaptor combination about the user's neck like a drawstring. The toggle 110*c* allows a user to control the position of the hook assembly 110, and therefore the tightness of the sleeping bag about the neck or shoulders. In FIGS. 13 and 15, the elongated fastening elements are routed along the lower casing elements in from the edge of the adaptor so that an attached sleeping bag would underlap the edges of the adaptor/pad combination in order to seal out drafts. This adaptation is seen in section in FIG. 35 and accords with claim 20.

To eliminate drafts between the necks of the two users of the double version, a draft baffling yoke 305 is removably attachable with attachment means such as a strap 306. This yoke is seen in perspective in FIG. 21, in lateral section in FIG. 24 and in longitudinal section in FIG. 33. It comprises essentially a fabric shell stuffed with insulating material. This yoke could also extend around both shoulders of each user and open at the throat possibly including a pair of hoods.

FIG. 21 also illustrates a convertible embodiment with three instead of two longitudinal fastening elements. The central longitudinal fastening element runs generally up the centre of the bottom of this embodiment so that a single user can put a pad 500 in just one side of the adaptor and zip a sleeping bag on one side to the usual fastening element and on the other side to the central fastening element for an effect roughly equivalent to that of the single version portrayed in FIGS. 6–8. This same adaptor can be used as a double adaptor by ignoring the central longitudinal fastening element.

To eliminate the problem of the sleeping bag curving outward on each side with single versions and contacting wet snow or dirt, moisture impermeable skirts 300, can be removably attached on either side. Using straps or similar fastening devices 301. FIG. 22 is a perspective of this assembly with an extra skirt laid alongside for clarity, and FIG. 30 is the same assembly in section.

An alternative embodiment of the present invention integrates the camping pad and adaptor into a single unit to save weight, etc. The pad element may be the inflatable, open cell foam filled variety which is currently popular. FIGS. 26 and 27 give a perspective of two embodiments of such an adaptor. Both have a free portion of upper sheet 204, attached along its tailmost edge to the adaptor, and to which the drawing means 110, and the head end of the longitudinal fastener are attached so that the drawing means can operate freely. Both comprise an insulating open cell foam core encapsulated by an air tight sheath, a valve 203, controls ingress and egress of air from the chamber occupied by the foam. Both are shaped to provide baffles 205 and 215, along the longitudinal fastening elements to prevent drafts. The former, sectioned in FIG. 28, has the baffle outboard of the fastener and the latter, sectioned in FIG. 29 has the baffle inboard of the fastener. FIG. 34 is a longitudinal section of either FIG. 26 or 27, and FIG. 32 is a longitudinal section of the mummy version of the integral pad embodiment. The idea of a semi-rigid baffle alongside the longitudinal fastener is a useful one and can be adapted to the sleeve type or preferred embodiment of the invention since underlapping the adaptor with the sleeping bag, as seen in FIGS. 13, 15 and 35, decreases the total volume available to the reclining user, and exposes the edge of the sleeping bag to crushing and moisture, etc. FIGS. 36–38 portray such a baffle 310, in section. It can comprise a fabric shell 310*a*, a closed cell foam stiffener 310*b*, and a quantity of insulation 310*c*. It can be attached to the adaptor by sewing and if the stitches go through the stiffener 310*b*, the baffle tends to lie flat against the fastener 106 or 146, so that an attached sleeping bag will be tightly held against the baffle 310 effectively sealing out drafts as in FIG. 38.

Not all varieties of commercially available sleeping bags have identical zippers. An adaptor according to the present invention which could mate universally with any type of zipper would incorporate a resilient "U"-shaped tube 315, as shown in FIGS. 39–41, which can removably clamp onto each zipper element of the sleeping bag as in FIG. 41. The section in FIG. 39 is taken between the straps on a strap bottom model.

The embodiments of the invention in which an exclusive property or privilege is claimed are defined as follows:

1. An adapter for fastening a sleeping bag to a camping pad, said adapter comprising, (a) an upper casing sheet of flexible material of sufficient size to accommodate one or two sleeping humans, said casing sheet comprising a head end, a foot end, a right edge which runs from said head end to said foot end, a left edge which runs from said head end to said foot end, and a longitudinal axis substantially midway between and substantially parallel to said left and right edges, (b) a lower casing element positioned substantially along said edges of said upper casing sheet whereby one or more lower chambers is substantially defined beneath said upper casing sheet, said lower chambers able to accommodate one or more camping pads, (c) elongated fastening means having two matable elements, one element disposed substantially along said right edge and one element disposed substantially along said left edge both running from said head end toward said foot end until a point is reached where said elongated fastening elements begin to substantially taper closer to one another as they approach said foot end whereby the zipper elements of a commercially available sleeping bag may removably attach to said adapter more closely together at said foot end than at said head end thus the feet of a user may be accommodated more comfortably.

2. An adaptor according to claim 1, wherein said upper casing comprises a free portion and said elongated fastening elements comprise a head end terminus, said head end terminus of each of said elongated fastening elements attaches to said free portion of said upper casing sheet which substantially comprises said head end of said upper casing sheet, is located adjacent to the head and shoulders region of a user and is sufficiently free from attachment at its sides to permit lateral compression independent of the main body of said adapter whereby an attached sleeping bag may be drawn around the neck of a user.

3. An adapter according to claim 1 further comprising means for drawing said elongated fastening means close together in a region near said head end of said adapter.

4. An adapter according to claim 3 wherein said drawing means comprises a length of cord attached to said adapter.

5. An adapter according to claim 4 wherein said cord is provided with a hook shaped attachment whereby a sliding tab on a zipper may be engaged.

6. An adapter according to claim 5 wherein said cord is provided with means for clamping said cord anywhere along its length whereby the position of said hook along said cord may be variably controlled.

7. An adapter according to claim 6 wherein said clamping means is a spring loaded cord lock.

8. An adapter for fastening a sleeping bag to a plurality of camping pads, said adapter comprising, (a) an upper casing sheet of flexible material of sufficient size to accommodate one or two sleeping humans, said casing sheet comprising a head end, a foot end, a right edge which runs from said head end to said foot end, a left edge which runs from said head end to said foot end, and a longitudinal axis substantially midway between and substantially parallel to said left and right edges, (b) a lower casing element positioned substantially along said edges of said upper casing sheet whereby a plurality of substantially rectangular lower chambers is substantially defined beneath said upper casing sheet, each of said lower chambers able to accommodate a camping pad, (c) elongated fastening means having two matable elements, one element disposed substantially along said right edge and one element disposed substantially along said left edge, both running from said head end more than one third of the distance towards said foot end until a point is reached where said elongated fastening elements begin to substantially taper closer to one another as they approach said foot end whereby the zipper elements of a commercially available sleeping bag may removably attach to said adapter more closely together at said foot end than at said head end thus the feet of a user may be accommodated more comfortably.

9. An adapter according to claim 8 wherein said upper casing sheet comprises a free portion and said elongated fastening elements comprise a head end terminus, said head end terminus of each of said elongated fastening elements attaches to said free portion of said upper casing sheet which substantially comprises said head end of said upper casing sheet, is located adjacent to the head and shoulders region of the users and is sufficiently free from attachment at its sides to permit lateral compression independent of the main body of said adapter whereby an attached sleeping bag may be drawn around the necks of the users.

10. An adapter according to claim 8 wherein said upper casing sheet further comprises means for drawing said elongated fastening means close together in a region near said head end of said adapter.

11. An adapter according to claim 10 wherein said drawing means comprises a length of cord attached to said adapter.

12. An adapter according to claim 11 wherein said cord is provided with a hook shaped attachment whereby a sliding tab on a zipper may be engaged.

13. An adapter according to claim 12 wherein said cord is provided with means for clamping said cord anywhere along its length whereby the position of said hook along said cord may be variably controlled.

14. An adapter according to claim 13 wherein said clamping means is a spring loaded cord lock.

15. An adapter according to claim 1 or 8 wherein said elongated fastening elements at mid foot end are less than 35 centimeters apart.

16. An adapter according to claim 1 or 8 wherein said lower casing element comprises a plurality of straps defining a chamber between 40 and 120 centimeters wide.

17. An adapter according to claim 1 or 8 comprising an insulated baffle positioned adjacent to said elongated fastening means whereby drafts are prevented communication with said upper chamber.

18. An adapter according to claim 17 wherein said baffle comprises an element of closed cell foam whereby said baffle will substantially stand taut against said elongated fastening means.

19. An adapter according to claim 1 or 8 comprising a spine running substantially along said longitudinal axis of said adapter, said spine comprised of essentially narrow flexible material, having an uppermost edge and a lowermost edge, said uppermost edge attached to said upper casing sheet and said lowermost edge attached to said lower casing element whereby said upper casing sheet and said lower casing element may be held proximal to one another without actually touching each other, whereby said adapter will define two lower chambers, essentially rectangular in cross section and will permit two camping pads removably contained therein to be held tightly together side by side excluding any gap which would arise if said upper casing sheet and said lower casing element were attached directly to one another.

20. An adapter according to claim 1 or 8 wherein said casing elements are fabric and selected from the group consisting of nylon, polyester, cotton, rayon, and dacron.

21. An adapter according to claim 1 or 8 wherein said fastening elements taper generally towards a single point substantially describing a V-shape during the last one third of the distance towards said foot end whereby a mummy style sleeping bag which does not open out completely flat may conveniently be removably attached.

22. An adapter according to claim 1 or 8 comprising an insulated foot pad comprising a top edge, a right peripheral edge and a left peripheral edge and a lower edge, said foot pad being attached by said lower edge to said adapter near said foot end of said adapter at approximately ninety degrees to said longitudinal axis of said adapter and substantially centered in said longitudinal axis of said adapter and being able to stand substantially vertically, and wherein as said two elongated fastening elements run toward said foot end they meet said foot pad and, breaking attachment with the main body of said adapter, assume attachment with said foot pad near said bottom edge, one of said elongated fastening elements following a route near and parallel to said right peripheral edge and the other elongated fastening element following a route near and parallel to said left peripheral edge, both meeting and following said top edge in a mutually converging manner until substantially meeting one another, whereby a barrel style sleeping bag may conveniently be removably attached.

23. An adapter according to claim 22 wherein said foot pad comprises a semi-rigid element whereby said foot pad may maintain a substantially coplaner shape and extend upwards and sideways beyond said elongated fastening means to provide a foot pad baffle against drafts said foot pad comprising a front side facing toward said head end and a back side facing away from said adapter said elongated fastening means being attached to said back side of said foot pad whereby the foot end of an attached sleeping bag would need to wrap around said foot pad baffle in order to reach said elongated fastening means.

24. An adapter according to claim 23 wherein said semi-rigid element comprises closed cell plastic foam.

25. An adapter according to claim 22 wherein each of said two elongated fastening elements are between 225 and 300 centimeters long.

26. An adapter according to claim 1 or 8 comprising an insulated yoke substantially shaped like a letter H laid on its side removably attached to said adapter at a point adjacent to the heads and shoulders of a pair of users whereby drafts between the necks of two users may be eliminated.

27. An adapter according to claim 26 wherein said yoke surrounds the necks of two users.

28. An adapter for fastening a sleeping bag to one or more camping pads, said adapter comprising, (a) an upper casing sheet of flexible material of sufficient size to accommodate one or two sleeping humans, said casing sheet comprising a head end, a foot end, a right edge which runs from said head end to said foot end, a left edge which runs from said head end to said foot end, and a longitudinal axis substantially midway between and substantially parallel to said left and right edges (b) a lower casing element positioned substantially along said edges of said upper casing sheet whereby one or more substantially rectangular lower chambers may be defined substantially beneath said upper casing sheet, each of said lower chambers able to accommodate a camping pad, (c) elongated fastening means having two matable elements, one element disposed substantially along said right edge and one element disposed substantially along said left edge both running from said head end toward said foot end until a point is reached where said elongated fastening elements begin to substantially taper closer to one another as they approach said foot end whereby the zipper elements of a commercially available sleeping bag may removably attach to said adapter more closely together at said foot end then at said head end thus the feet of a user may be accommodated more comfortably, (d) means far drawing said elongated fastening means close together in a region near said head end of said adapter.

29. An adapter according to claim 28 wherein said upper casing sheet comprises a free portion and said elongated fastening elements comprise a head end terminus, said head end terminus of each of said elongated fastening elements attaches to said free portion of said upper casing sheet which substantially comprises said head end of said upper casing sheet, is located adjacent to the head and shoulders region of the users and is sufficiently free from attachment at its sides to permit lateral compression independent of the main body of said adapter whereby an attached sleeping bag may be drawn around the necks of the users.

30. An adapter according to claim 28 wherein said drawing means comprises a length of cord attached to said adapter.

31. An adapter according to claim 30 wherein said cord is provided with a hook shaped attachment whereby a sliding tab on a zipper may be engaged.

32. An adapter according to claim 31 wherein said cord is provided with means for clamping said cord anywhere along its length whereby the position of said hook along said cord may be variably controlled.

33. An adapter according to claim 32 wherein said clamping means is a spring loaded cord lock.

* * * * *